United States Patent [19]

Hutchison et al.

[11] 4,432,309

[45] Feb. 21, 1984

[54] COOLING SYSTEM FOR AIR-COOLED ENGINE

[75] Inventors: Wayne R. Hutchison, Mayville; John G. Meylink, Horicon, both of Wis.

[73] Assignee: Deere & Company, Moline, Ill.

[21] Appl. No.: 347,121

[22] Filed: Feb. 9, 1982

[51] Int. Cl.[3] ..... F01P 5/06

[52] U.S. Cl. ..... 123/41.66; 123/41.7; 180/54 A

[58] Field of Search ..... 123/41.56, 41.58, 41.59, 123/41.66, 41.7, 198 E; 180/69.2, 54 A, 54 E, 54 R, 89.17, 90, 900; 244/53 B; 181/204, 205

[56] References Cited

U.S. PATENT DOCUMENTS

| | | | |
|---|---|---|---|
| 3,319,732 | 5/1967 | Soeteber et al. | 180/68.1 X |
| 3,796,277 | 3/1974 | Gordon | 180/69.2 |
| 3,986,574 | 10/1976 | Irvine | 180/69 R |
| 3,987,766 | 10/1976 | Welck | 123/41.66 |

*Primary Examiner*—William A. Cuchlinski, Jr.

[57] ABSTRACT

A lawn and garden tractor includes an air-cooled engine having a vertical crankshaft and a shroud which defines an upwardly opening inlet and a downwardly opening outlet. Air is channeled to the inlet from a zone extending behind and at the opposite sides of a pedestal located at the forward end of an operator's station by means of walls of the pedestal, a hood overlying the engine and joining the top of the pedestal, and a U-shaped baffle extending forwardly and along opposite sides of the shroud inlet.

7 Claims, 4 Drawing Figures

COOLING SYSTEM FOR AIR-COOLED ENGINE

BACKGROUND OF THE INVENTION

The present invention relates to cooling systems for air-cooled engines and more particularly relates to such systems as embodied in lawn and garden tractors.

Lawn and garden tractors using air-cooled engines require large quantities of air as close to ambient temperature as possible in order to sufficiently cool the engines when the tractors are under load. Accordingly, it is necessary to prevent exhaust gases from mixing with incoming cooling air and to prevent the cooling air from recirculating once it has passed over the engine in order to avoid or at least lessen problems of engine overheating.

One type of air-cooled engine that is used in lawn and garden tractor designs includes a vertically disposed crankshaft having a cooling air fan mounted on the upper end thereof for drawing cooling air into an upwardly opening inlet defined by a shroud of the engine. The cooling system of the present invention is for this type of engine.

A cooling system, somewhat similar to that of the present invention, is disclosed in U.S. Pat. No. 3,987,766 granted to Arnold E. Welck on Oct. 26, 1976. In this patented system, the engine is located in a compartment defined at least in part by a pair of vertical sidewalls and a hood having opposite sides disposed in overlying, spaced relationship to upper edges of the sidewalls so as to define elongate gaps at the opposite sides of the engine for permitting air to be drawn into the engine shroud by the cooling fan. A horizontal baffle plate surrounds the shroud inlet and extends to the sidewalls, and a vertical baffle plate joins the horizontal baffle plate at a location forwardly of the shroud inlet and has an upper edge which sealingly engages the underside of the hood. These baffle plates act to prevent air that has exited from the engine shroud and from the engine exhaust system from recirculating through the engine shroud by way of a path within the engine compartment.

While the cooling system disclosed in the patent is generally satisfactory, it has the drawback that some recirculation of heated air does occur, and the air at the opposite sides of the tractor sometimes becomes laden with dirt and other foreign matter which tends to collect on the cooling fans of the engine which tends to decrease the heat transfer from the engine. Also, the upper surface of the horizontal baffle tends to collect dirt and the like.

SUMMARY OF THE INVENTION

According to the present invention, there is provided an air intake system which represents an improvement over the system disclosed in the aforedescribed U.S. Pat. No. 3,987,766.

An object of the invention is to provide an engine cooling air system for routing relatively clean air at ambient temperature to an air-cooled engine employed in a lawn and garden tractor.

A further object of the invention is to provide an engine cooling system which accomplishes the previously stated object without necessitating the cutting of holes or louvers in the hood.

A more specific object of the invention is to provide an engine cooling system as set forth hereinabove, wherein an upright baffle, the hood and a control pedestal cooperate to channel cooling air to the engine shroud inlet from a zone at the operator's station adjacent the pedestal.

Yet another object of the invention is to route cooling air to the engine shroud inlet from a zone located above and no further forward than the forwardmost edge of foot rests extending longitudinally at opposite sides of the tractor.

These and other objects will become apparent from a reading of the following description together with the appended drawings.

DESCRIPTION OF THE PREFERRED EMBODIMENT

Figure 1:
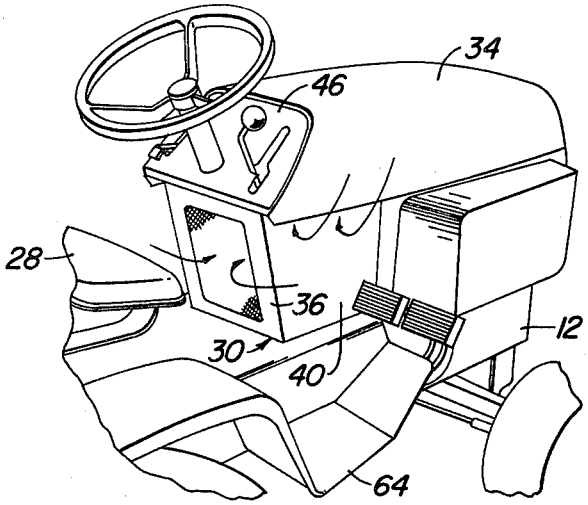
FIG. 1 is a right rear perspective view of a lawn and garden tractor embodying an air-cooled engine cooling system constructed in accordance with the principles of the present invention.
Figure 4:
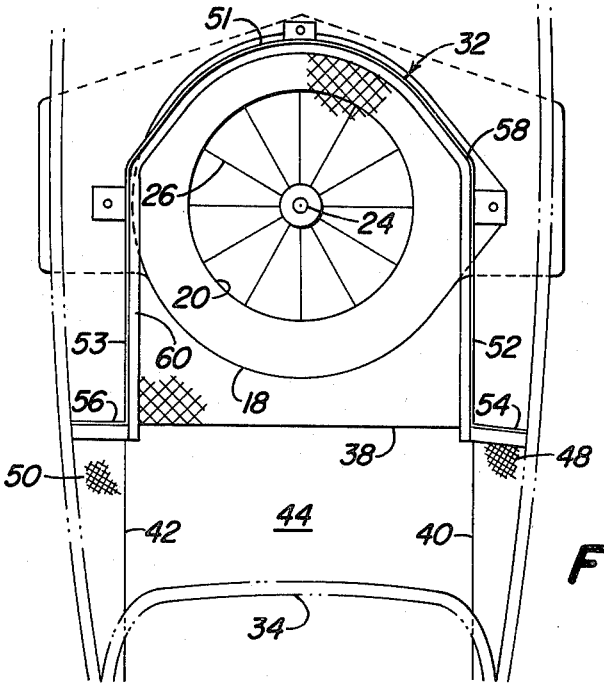
FIG. 4 is a top plan view showing the U-shaped baffle in place and showing the tractor hood in phantom.

Referring now to FIG. 1, therein is shown a lawn and garden tractor indicated in its entirety by the reference numeral 10. The tractor 10 includes a longitudinal main frame 12 including a pair of spaced apart channel members joined by a generally horizontal engine mounting plate 14. Mounted on the plate 14 is an air-cooled engine 16 having a shroud 18 disposed about its block and defining an upwardly-opening, circular inlet 20 at its top and defining a downwardly and forwardly opening outlet 22 at its lower front. As can best be seen in FIG. 4, the engine 16 has a vertically disposed crankshaft 24, and mounted on the upper end of the shaft, at a location below the inlet, is a cooling air fan 26 which operates to draw cooling air over the engine block.

Figure 2:
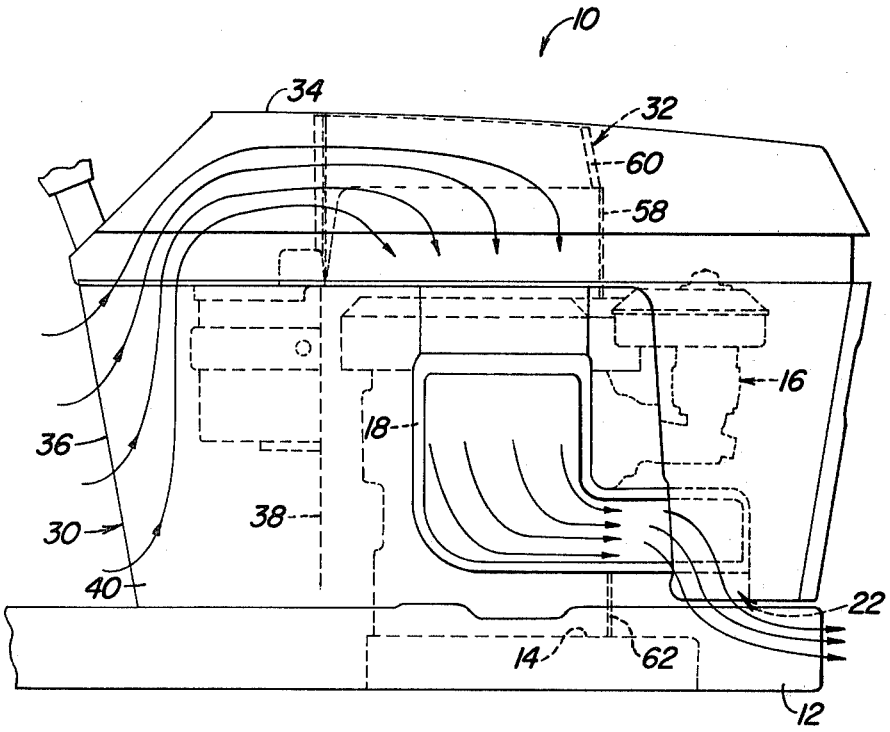
FIG. 2 is a right side elevational view of the tractor showing the engine cooling air flow path.
Figure 3:
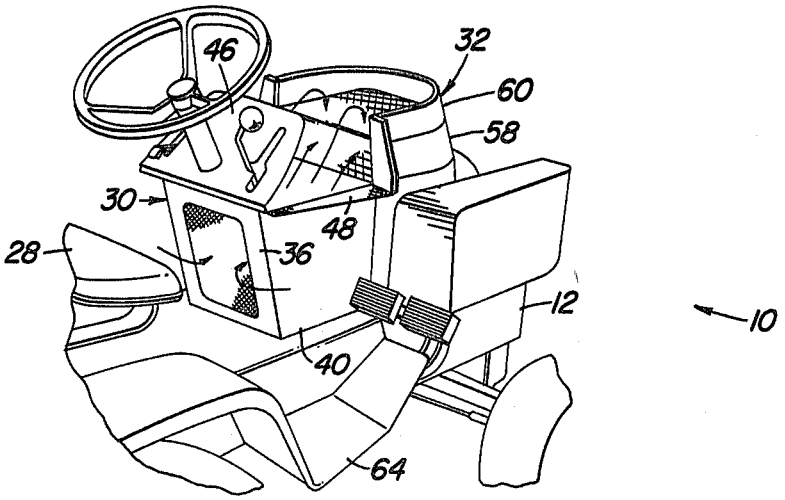
FIG. 3 is a view similar to FIG. 1, but with the hood removed.

Structure for channeling or directing air to the cooling air inlet 20 from a zone forwardly of an operator seat 28 is defined by an upright pedestal 30 located on the frame 12 rearwardly of the engine, a baffle 32 positioned about the inlet 20 and a hood 34. Specifically, the pedestal 30 includes a perforated rear wall 36, a forward wall 38 and right- and left-hand sidewalls 40 and 42, respectively, which cooperate to define an open-topped compartment 44. Forming an upper extension of the rear wall 36 is an instrument panel 46 which is inclined forwardly above the compartment. The hood 34 is generally U-shaped in vertical, transverse cross section and has a rear end portion which fits the periphery of the panel 46 when the hood is in its closed position, as illustrated in FIGS. 1 and 2. Opposite sidewalls of the hood 34 are respectively spaced outwardly from the pedestal sidewalls 40 and 42, and filling the gaps thus formed between the pedestal and the hood are right- and left-hand screens 48 and 50 which are respectively secured to the top edges of and extend horizontally from the sidewalls 40 and 42. As can best be seen in FIG. 4, the baffle 32 is generally U-shaped in top view and is secured to the shroud 18 so that a curved bight portion 51 thereof is located forwardly of the inlet 20 and right and left legs 52 and 53, respectively, thereof extend rearwardly from the bight portion along opposite sides of the inlet. The legs 52 and 53 have respective out-turned terminal end portions 54 and 56, which are located adjacent forward ends of the screens 48 and 50 and sealingly engage the hood. A lower portion of the baffle is formed by a thin sheet metal band 58 and a band of resilient foam material 60 is supported by the band and extends thereabove. The upper edge of the foam material is shaped to sealingly engage the underside of the hood 34.

As indicated by the arrows in FIG. 2, it can be seen that the fan 26 will operate to draw air into the compartment defined by the pedestal 30 by way of the perforated rear wall 36. Additionally, air will be drawn in from locations at the opposite sides of the pedestal by way of the screens 48 and 50. The air drawn in by the fan will pass through the shroud by way of the inlet 20 and outlet 22 and be exhausted so as to impinge upon the exhaust system of the engine.

It is here noted that the engine 16 is secured to the mounting plate 14 by mounts which hold the base of the engine above the plate. To prevent the air being exhausted from the shroud and the gasses being exhausted from the exhaust system from finding their way back to the cooling air stream entering the shroud, a transversely-extending, vertical heat baffle 62 is located so as to fill the gap between the bottom of the engine 16 and the plate 14 at a location just rearwardly of the shroud outlet 22. It will be appreciated that the aforementioned U-shaped baffle 32 performs a similar function in that it prevents heated air and exhaust gasses from entering the shroud inlet along a path extending along the front and opposite sides of the engine.

It is further noted that a right foot rest 64 and a corresponding left foot rest (not shown) form platforms which extend along opposite sides of and project outwardly from the sides of the pedestal 30 at locations vertically below the screens 48 and 50. The presence of the foot rests aids in preventing dust and other foreign matter that may be stirred up by the front tires of, or equipment mounted on the tractor from entering the cooling air stream. Should any foreign matter, such as grass clippings or leaves, find its way to the air stream, the screens 48 and 50 and the perforated rear wall 36 of the pedestal will intercept it and prevent it from entering the shroud and possibly being trapped therein resulting in impairment of the air flow and consequently in diminishing the cooling capability of the air-cooling system.

We claim:

1. In a lawn and garden tractor embodying an air-cooled engine and a cooling system therefor, the engine having a shroud, defining an upwardly opening inlet, and a cooling air fan for drawing air into the inlet, an operator's station located rearwardly of the engine and including a hollow pedestal, a hood extending over the engine and having a rearward end portion closing the top of the pedestal, an improved cooling system, comprising: an upright, air impervious baffle extending forwardly of and along opposite sides of the shroud inlet and having upper and lower edges respectively engaged throughout their length with the hood and the engine; and air inlet means formed in the pedestal.

2. The invention defined in claim 1 wherein the air inlet means includes a perforated rear wall portion of the pedestal.

3. The invention defined in claim 2 wherein the pedestal has out-turned flanges at opposite upper side portions thereof; said air inlet means includes perforations located in the out-turned flanges; and the hood engages respective outer peripheral edges of the flanges.

4. The invention defined in claim 1 wherein the baffle includes a lower portion in the form of a sheet metal band and an upper portion in the form of a flexible foam material.

5. The invention defined in claim 1 wherein the frame includes a generally horizontal mounting plate, with the engine being mounted to the plate so as to leave a gap between the engine and the plate; and a transverse vertical heat baffle being located between the engine and the plate at a location just behind the shroud outlet so as to prevent the recirculation of cooling air through the gap.

6. In a lawn and garden tractor embodying an air-cooled engine and a cooling system therefor, the engine having a shroud, defining an upwardly opening inlet, and a cooling air fan for drawing air into the inlet, an operator's station located rearwardly of the engine and including a hollow pedestal, and a platform extending to the opposite sides of and rearwardly from the base of the pedestal, a hood extending over the engine and having a rearward end portion closing the top of the pedestal, an improved cooling system, comprising: an upright, air impervious baffle extending forwardly of and along opposite sides of the shroud inlet and having upper and lower edges respectively engaged throughout their length with the hood and the engine; and air inlet means formed in the pedestal.

7. In a lawn and garden tractor embodying an air-cooled engine and a cooling system therefor, the engine having a shroud defining an upwardly opening inlet and a cooling air fan for drawing air into the inlet, a pedestal defining an open-topped compartment located rearwardly of the engine and having a rear wall, a hood extending over the engine and having a rearward end portion closing the top of the compartment, an improved cooling system, comprising: an upright baffle extending forwardly of and along opposite sides of the shroud inlet and having upper and lower edges respectively engaged with the underside of the hood and with the engine; and the pedestal having air inlet openings provided in the rear wall thereof; whereby the fan will draw air into the shroud from a zone rearwardly of the pedestal.

* * * * *